US012716679B2

(12) United States Patent
Lipowski et al.

(10) Patent No.: US 12,716,679 B2
(45) Date of Patent: Aug. 25, 2026

(54) FLEXIBLE LATCH FOR TRIGGER DEVICE

(71) Applicant: 2360216 ONTARIO INC., Mississauga (CA)

(72) Inventors: Mats Lipowski, Mississauga (CA); Jonathan Hensel, Mississauga (CA)

(73) Assignee: 2360216 ONTARIO INC., Mississauga (CA)

( * ) Notice: Subject to any disclaimer, the term of this patent is extended or adjusted under 35 U.S.C. 154(b) by 159 days.

(21) Appl. No.: 18/899,168

(22) Filed: Sep. 27, 2024

(65) Prior Publication Data

US 2025/0109922 A1 Apr. 3, 2025

Related U.S. Application Data

(60) Provisional application No. 63/586,813, filed on Sep. 29, 2023.

(51) Int. Cl.
*F41B 5/14* (2006.01)
*F41B 5/12* (2006.01)

(52) U.S. Cl.
CPC ..... *F41B 5/1469* (2013.01); *F41B 5/12* (2013.01)

(58) Field of Classification Search
None
See application file for complete search history.

(56) References Cited

U.S. PATENT DOCUMENTS 5,649,520 A * 7/1997 Bednar ..... F41B 5/12 124/40
9,404,701 B2 * 8/2016 Lipowski ..... F41A 19/10
10,508,884 B1 * 12/2019 Chen ..... F41A 17/46

* cited by examiner

*Primary Examiner* — Reginald S Tillman, Jr.
(74) *Attorney, Agent, or Firm* — Perry + Currier

(57) ABSTRACT

A trigger device is described comprising a string hook, a trigger, a sear, and a flexible latch. The string hook is configured to retain a bowstring. The sear is coupled to the trigger and configured to release the string hook in response to actuation of the trigger. A flexible latch is coupled between the string hook and the sear. The flexible latch has a flexure design configured to flex in response to a holding weight applied by the bowstring, wherein flexure of the flexible latch reduces a pull weight of the trigger.

13 Claims, 5 Drawing Sheets

FLEXIBLE LATCH FOR TRIGGER DEVICE

CROSS-REFERENCE TO RELATED APPLICATIONS

This application claims priority to U.S. Provisional Application No. 63/586,813, titled "Flexible Latch for Trigger Device", filed on Sep. 29, 2023, the content of which is incorporated fully herein by reference.

FIELD

The present description relates generally a trigger device and specifically to a flexible latch for a crossbow trigger device.

BACKGROUND

Crossbows have long been known in the archery field for use in competitive shooting sports and hunting game. Crossbows have higher draw weights than conventional archery bows and fire arrows (or bolts) with greater speeds. Crossbows are able to lock or latch the crossbow string in the ready to fire position once the string is drawn. This feature allows archers to retain and release a draw weight in excess of what is typically achievable with a traditional bow. Crossbow cocking devices, such as cranks for example, allow for an even greater draw weight to be used.

When crossbows are configured for firing, the draw weight exerted by the retracted bowstring is typically in the range of approximately 100 to 400 pounds. The crossbow's trigger device must be capable of holding the bowstring in a ready-to-fire position until the bowstring is released when a user pulls the trigger. However, the greater the draw weight of the crossbow, the greater the pull weight the user must exert upon the trigger of the crossbow to fire the arrow. This is especially true for crossbows configured to provide bowstrings with adjustable draw weights. A variation in pull weight can decrease the accuracy of the shot.

Accordingly, it is desirable to be able to provide a trigger device that obviates or mitigates at least some of the above mentioned disadvantages.

SUMMARY

In accordance with an aspect of an embodiment, there is provided a trigger device comprising: a string hook configured to retain a bowstring; a trigger; a sear coupled to the trigger, the sear configured to release the string hook in response to actuation of the trigger; and a flexible latch coupled between the string hook and the sear, the flexible latch having a flexure design configured to flex in response to a holding weight applied by the bowstring, wherein flexure of the latch reduces a pull weight of the trigger.

In an embodiment, the flexure of the latch may reduce a pull weight of the trigger by changing the angle at which the latch engages the sear as the holding weight increases. The flexure design may comprise a flexible leg formed in a bottom portion of the latch, the flexible leg comprising a forward facing sear engagement surface. Changing the angle of engagement may reduce the moment arm of a latch force L in relation to a pivot pin of the sear. Such reduction in the moment arm may thereby reduce the pull weight required to release the sear.

In an embodiment, the trigger device may further comprise a main roller coupled between the sear and the latch, the main roller configured to rotate about its axis and translate within predefined slots.

In an embodiment, the flexible leg may be formed by creating a channel in the latch. The channel may be shaped to mirror a contour of the flexible leg. The width of the channel may be sized to provide a maximum flex of the flexible leg. At least one stopper pin may be positioned within the channel, thereby tuning the maximum flex of the flexible leg.

In an embodiment, the flexible latch may be rotatably coupled to the string hook. The flexible latch may be fixedly attached to the string hook. The flexible latch and the string hook may comprise a unitary construction.

In an embodiment, the sear may be coupled to the trigger via a secondary roller configured to translate under pressure from the trigger.

In accordance with another aspect of an embodiment, there is provided a trigger device comprising: a string hook configured to retain a bowstring, the string hook rotatably coupled to the trigger device; a latch coupled to the string hook; a sear rotatably coupled to the trigger device; a trigger rotatably coupled to the trigger device; a main roller positioned between the latch and the sear, the main roller configured to rotate about its axis and translate within predefined slots in the trigger device; and a secondary roller positioned between the sear and the trigger; wherein actuation of the trigger causes the secondary roller to translate and rotate the sear, releasing the main roller which, in turn, releases the latch and the string hook.

In an embodiment, the latch may have a flexure design configure to flex in response to a holding weight applied by the bowstring such that flexure of the latch reduces a pull weight of the trigger. The latch may be rotatably coupled to the string hook. The latch may be fixedly attached to the string hook. The latch and the string hook may comprise a unitary construction.

BRIEF DESCRIPTION OF THE DRAWINGS

Embodiments of the invention will now be described by way of example only with reference to the following drawings in which.

DETAILED DESCRIPTION OF THE PREFERRED EMBODIMENTS

Figure 1:
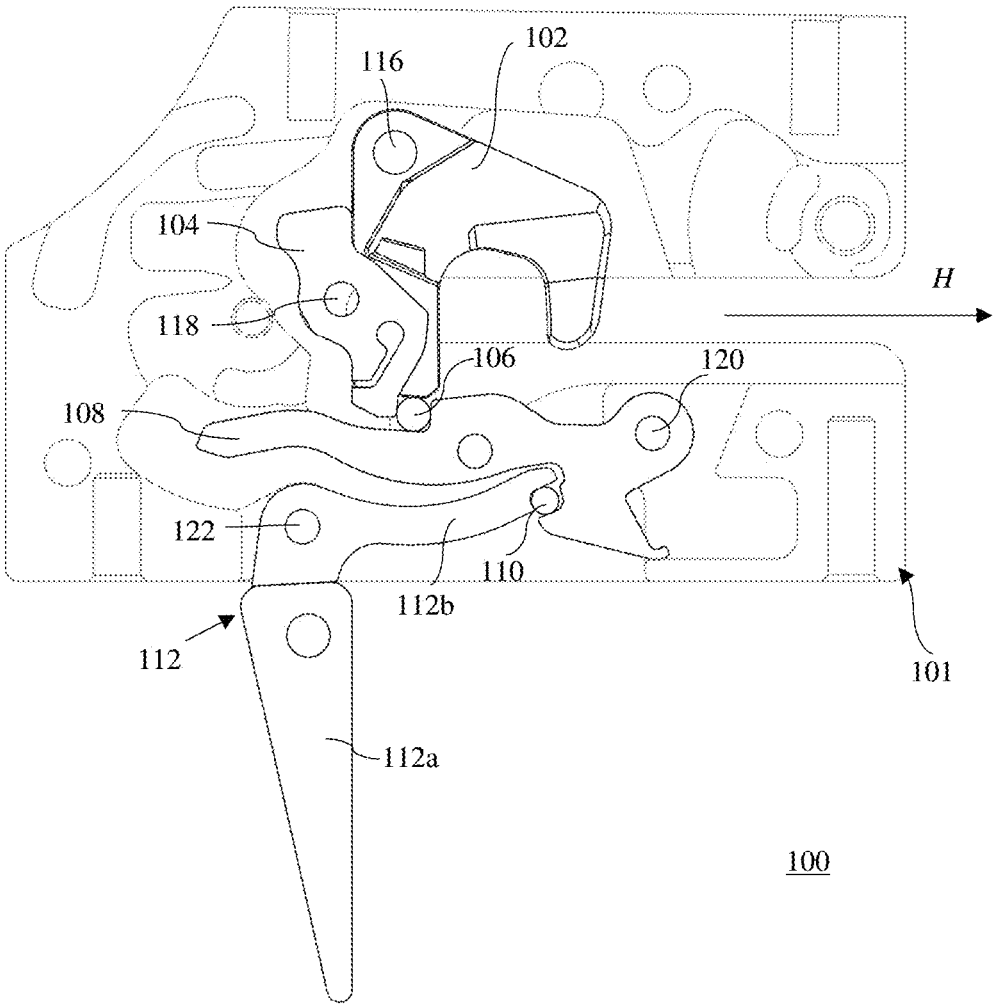
FIG. 1 is a side view of a trigger device.

For convenience, like numerals in the description refer to like structures in the drawings. Referring to FIG. 1, a trigger device for a crossbow is illustrated generally by numeral 100. The trigger device 100 comprises a housing 101, a string hook 102, a latch 104, a main roller 106, a sear 108, a secondary roller 110, and a trigger 112. The trigger 112 comprises a lever 112*a* and a transfer bar 112*b*. The trigger device 100 further comprises a string hook pivot pin 116, a latch coupling pin 118, a sear pivot pin 120, and a trigger pivot pin 122.

The string hook 102 is rotationally coupled to a housing 101 via the string hook pivot pin 116. The latch 104 is rotationally coupled to the string hook 102 via the latch coupling pin 118. The sear 108 is rotationally coupled to the housing 101 via the sear pivot pin 120. The trigger 112 is rotationally coupled to the housing 101 via the trigger pivot pin 122.

In an embodiment, the string hook 102 is biased in a clockwise direction about the string hook pivot pin 116 by a string hook spring (not shown). In an embodiment, the latch 104 is biased a clockwise direction about the latch coupling pin 118 by a latch spring (not shown). A portion of the string hook 102 is configured to engage with a portion of the latch 104.

The main roller 106 is configured rotate about its axis. The main roller 106 is further configured to translate vertically within predefined slots (not shown). The predefined slots may be in the housing 101 itself or otherwise coupled to the housing or fixed in place. The main roller 106 is configured to be held in position between a surface on the latch 104 and an opposing surface on the sear 108. The secondary roller 110 is configured to rotate about its axis. The secondary roller 110 is further configured to translate within predefined slots (not shown) in the housing 101 under pressure from the transfer bar 112*b*.

When a D-loop or bowstring is loaded onto the string hook 102, a holding weight His applied to the string hook 102 in a forward direction. The holding weight H is translated by the string hook 102 to a counter-clockwise rotational force. The string hook 102 abuts the latch 104, which in turn experiences a counter-clockwise rotational force from the string hook 102. The counter-clockwise rotational force experienced by the latch 104 is opposed by the sear 108 and the main roller 106 is held in place. The trigger device 100 is ready to fire.

Actuation of the lever 112*a* causes the trigger 112 to rotate clockwise about the trigger pivot pin 122. Rotation of the trigger 112 causes the transfer bar 112*b* to rotate and translate the secondary roller 110. Translation of the secondary roller 110 causes the sear 108 to rotate counter-clockwise about the sear pivot pin 120. As the sear 108 rotates, it disengages from the main roller 106, allowing the main roller 106 to translate. Once the main roller 106 has translated to a breaking point, the latch 104 is released. Release of the latch 104 releases the string hook 102 which, in turn, releases the D-loop.

Figure 2A:
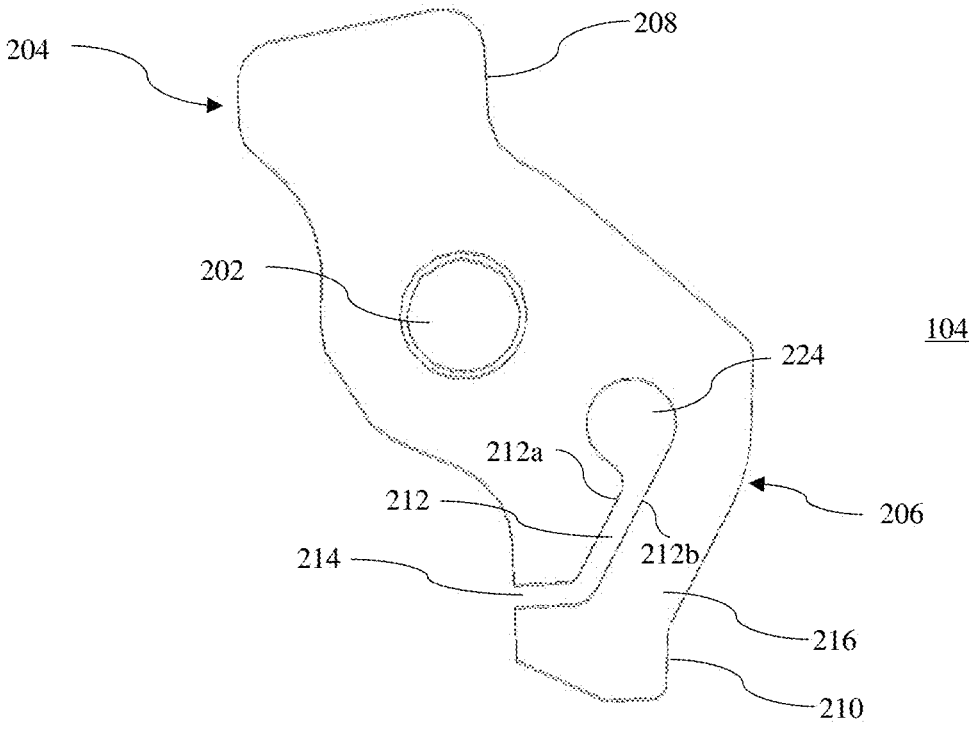
FIG. 2*a* is a side view of a flexible latch under no flex.

Referring to FIG. 2*a*, the latch 104 is illustrated in isolation. The latch 104 comprises an opening 202 for receiving the latch coupling pin 118. The latch further comprises an upper portion 204 and a lower portion 206. The upper portion 204 is substantially above the opening 202. The lower portion 206 is substantially below the opening 202. The upper portion 204 comprises a hook interface 208. In an embodiment, the hook interface 208 comprises a forward facing surface of the upper portion 204. The hook interface 208 is configured to engage a rear-facing surface of the string hook 102.

A flexure design is provided for the lower portion 206. In an embodiment, the flexure design comprises a channel 212 in the lower portion 206. In an embodiment, the channel 212 is shaped to substantially mirror the contour of the lower portion 206. Accordingly, in the present embodiment, the channel 212 begins at an opening 214 in a rear facing surface of the lower portion 206. The channel moves inwards into the lower portion 206 and then inwards and upwards. The channel 212 comprises a pair of opposing side walls 212*a* and 212*b*. The channel 212 ends in a substantially circular opening 224 within the lower portion 206.

The channel 212 creates a flexible leg 216 at the bottom of the lower portion 206. The flexible leg 216 comprises a sear engagement interface 210. The sear engagement interface 210 is configured to engage the sear 108 via the main roller 106. In an embodiment, the sear engagement interface 210 comprises a forward facing surface of the flexible leg 216.

The latch 104 illustrated in FIG. 2*a* is unflexed. As will be described below, a latch force L is applied at the sear engagement interface 210 when the bowstring is drawn and held. The latch force L depends, at least in part, on the draw weight and the holding weight of the bowstring. In an embodiment, the holding weight and the draw weight are the same. In another embodiment, the crossbow may comprise a series of cams to aid in cocking the drawstring. The cams may result in a peak draw weight that is higher than the eventual holding weight. Accordingly, in such an embodiment, the peak latch force L will be greater than the holding weight. In an embodiment, the latch 104 flexes as the pull weight increases. In another embodiment, the latch 104 remains unflexed until the latch force L reaches a minimum threshold force. As will be appreciated, the minimum threshold force may depend, at least in part, on the size and configuration of the flexure design of the latch 104, as well as the elasticity of latch material.

Figure 2B:
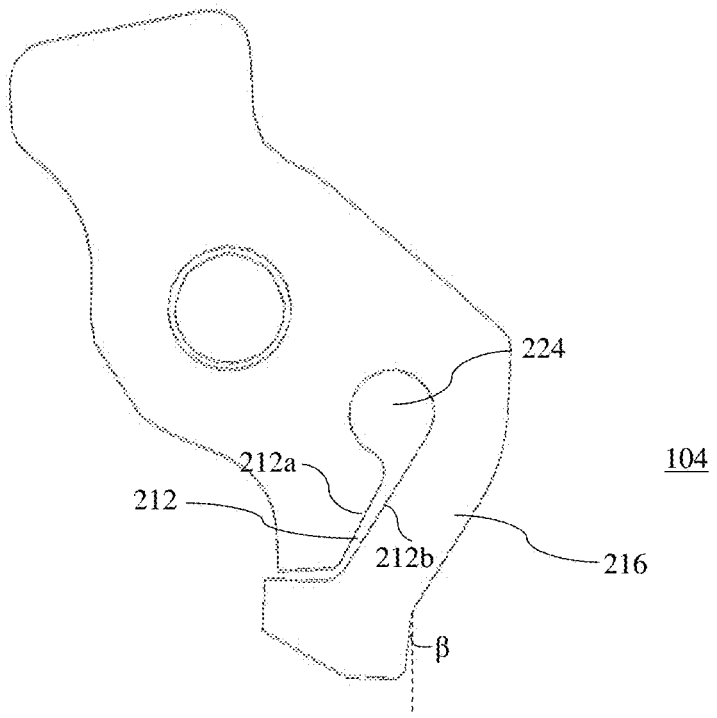
FIG. 2*b* is a side view of a flexible latch under flex.

Referring to FIG. 2*b*, the latch 104 is illustrated when flexed. As shown, the latch force L causes the leg 216 to flex rearward so that the channel 212 narrows. In an embodiment, the leg 216 flexes until the opposing side walls 212*a* and 212*b* are in contact with each other. Thus, the width of the channel 212 provides a maximum flex of the leg 216. As the leg 216 flexes under pressure from the latch force L, an angle β of the sear engagement interface 210 with respect to the vertical changes. In an embodiment, the angle β increases as the leg 216 flexes.

Figure 2C:
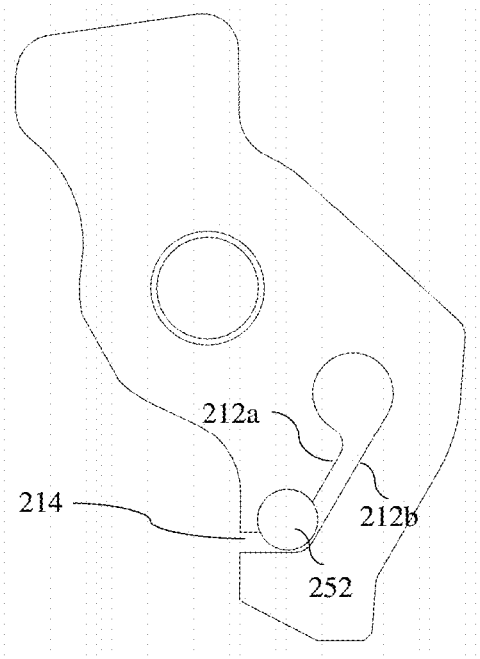
FIG. 2*c* is a side view of a flexible latch with a stopper pin.

In an embodiment, it may be desirable to limit the flex of the latch 104. This may be done for a number of different reasons. For example, a single latch design can be used to manufacture latches 104 for a plurality of different crossbows having different pull weights. As another example, it may be difficult to manufacture the latch 104 with the channel 212 having a sufficiently narrow width to provide a desired maximum flex. Accordingly, referring to FIG. 2*c*, another embodiment of the latch is illustrated generally by numeral 250. Similar to the latch 104 illustrated in FIGS. 2*a* and 2*b*, the latch comprises the channel 212. However, the width of the channel 212, and therefore the distance between the opposing side walls 212*a* and 212*b*, is greater than necessary for the operation of the latch 250. Accordingly, a stopper pin 252 is placed into the channel 212 to tune the flex of the leg 216. The size of the stopper pin 252 is designed to limit the flex of the leg 216 to a desired amount. The leg 216 flexes until its side wall 212*b* contacts the stopper pin 252.

As mentioned above, in some crossbow configurations, the peak draw weight is greater than the holding weight H. Accordingly, the latch 104 may over-flex under the peak draw weight, as there is no little to no benefit of the latch 104 flexing during the draw. Using the stopper pin 252 inhibits unnecessary stress on the latch 250. That is, the stopper pin 252 can be sized and positioned to limit the flex of the latch 250 to the holding weight H. Thus, even at the peak draw weight, the latch 250 will not flex more than if the holding weight H was applied.

In an alternate embodiment, multiple stopper pins 252 may be used to alter the flexure response of the latch 250. Each of the stopper pins 252 may respond differently to different holding weights. Thus, for example, the leg 216 may initially flex at a linear rate until it reaches a first stopper pin. The first stopper pin may slow the flex rate of the leg 216 until it reaches a second stopper pin. The second stopper pin may further slow the flex rate of the leg 216 until it reaches a third stopper pin, which stops the flex of the leg 21.

Figure 3A:
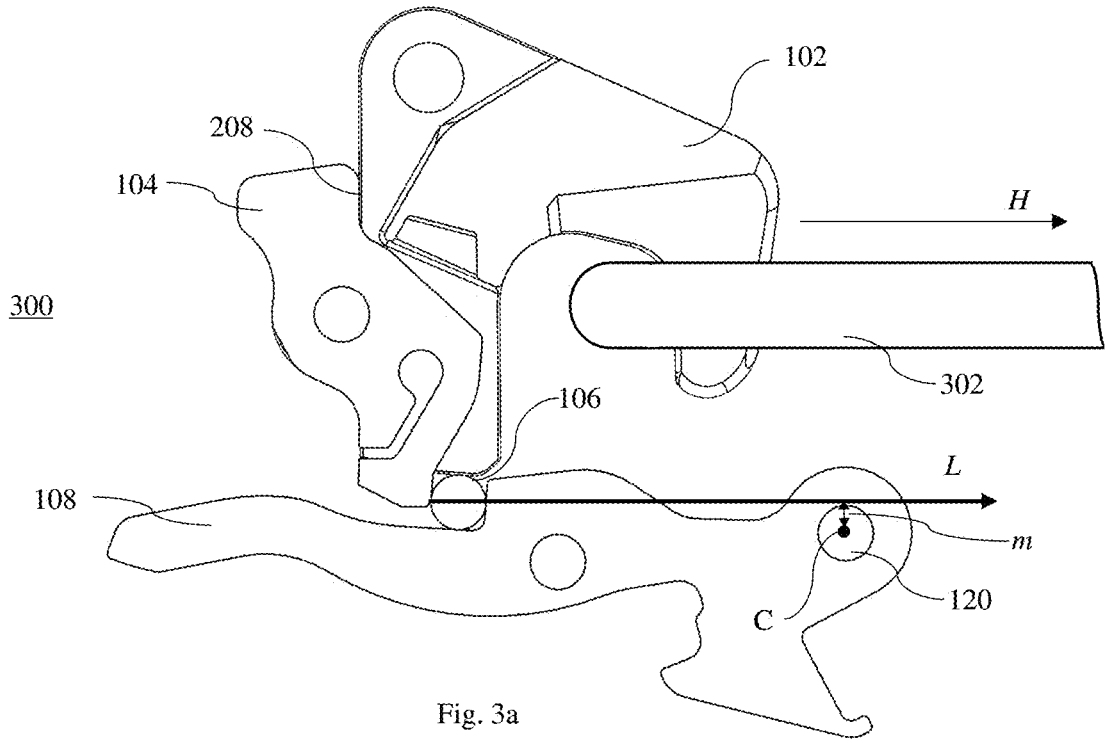
FIG. 3*a* is a side view of a loaded trigger under little or no flex.

Referring to FIG. 3*a*, a partial view of trigger device with the latch unflexed is illustrated generally by numeral 300. In this view, only the string hook 102, the latch 104, the main roller 106 and the sear 108 are shown for ease of illustration. A D-loop or bowstring 302 is illustrated engaged with the string hook 102. The D-loop 302 applies the holding weight H to the string hook 102. The holding weight His translated to a counter-clockwise rotational force on the string hook 102. The string hook 102 abuts the hook interface 208 of the latch 104. Accordingly, the latch 104 experiences a counter-clockwise rotational force from the string hook 102. Since the main roller 106 is held in place by the sear 108, the counter-clockwise rotational force experience by the latch 104 is translated to the latch force L at the sear engagement interface 210 which is applied to the main roller 106.

As a result of the configuration of the trigger device 100, when the holding weight H is low, the flex of the latch 104 is minimal, if anything. Thus, the latch force L is directed substantially horizontally, and above a pivot point C of the pivot pin 120. As the holding weight H for the bowstring increases, so does the latch force L. The increased latch force L increases the pull weight required to release the sear 108 and fire the trigger device 100.

Figure 3B:
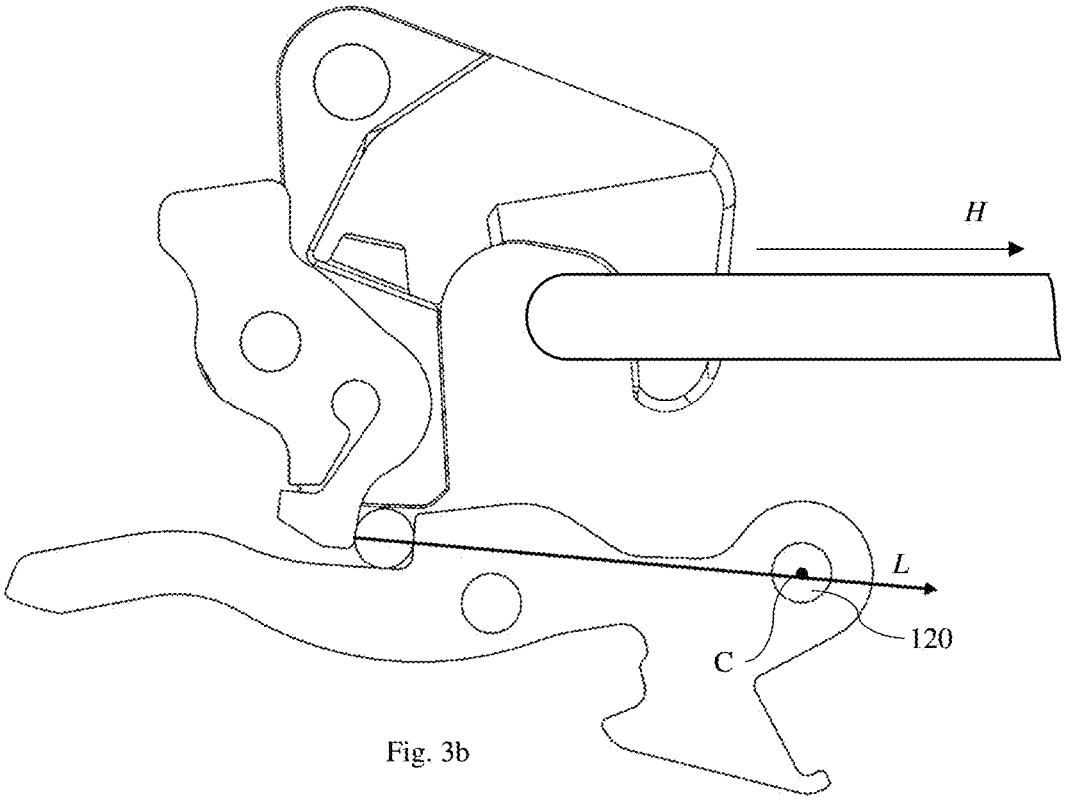
FIG. 3*b* is a side view of a loaded trigger under flex.

Referring to FIG. 3*b*, a partial view of trigger device with the latch flexed is illustrated generally by numeral 350. As the latch 104 begins to flex, the angle β of the sear engagement interface 210 with respect to the horizontal changes. As a result of the change of the angle β, the latch force L is directed below the horizontal and closer to the pivot point C of the sear pivot pin 120. The change in the angle β of the sear engagement interface 210 changes the moment arm m in relation to the pivot point C. As a result of the shorter moment arm m for the flexed latch 104, the pull weight required to release the sear 108 is reduced. The reduction in pull weight due to the change the angle of the sear engagement interface 210 at least partially offsets the increase in pull weight due to the increased holding weight H of the crossbow.

Figure 4:
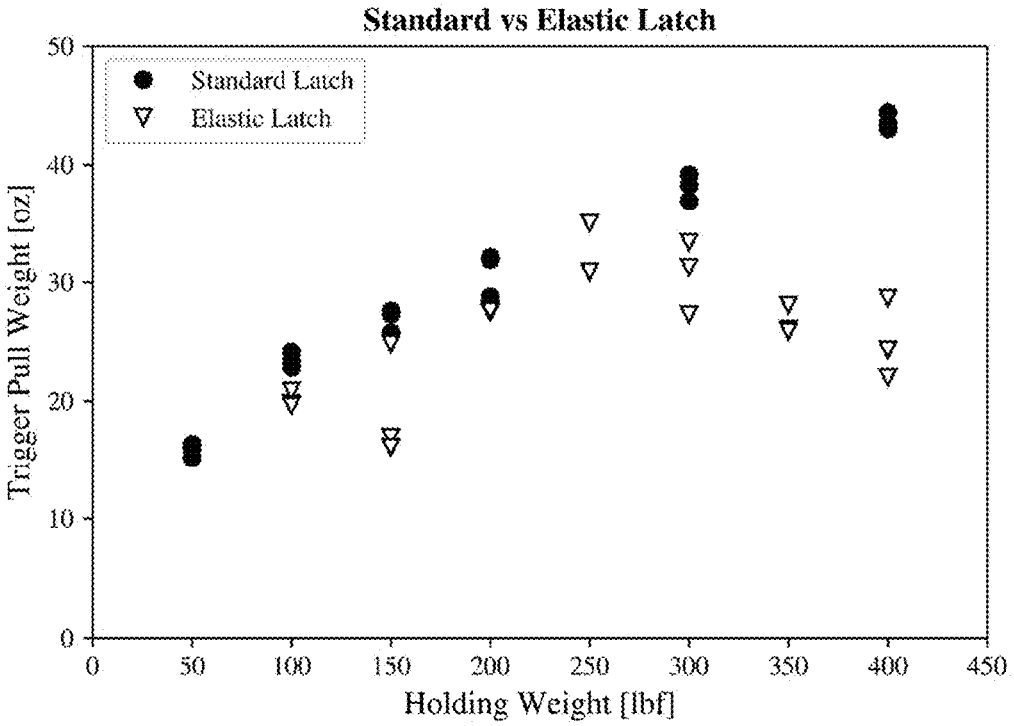
FIG. 4 is a graph showing the pull weight required to release a sear for different holding weights W.

Referring to FIG. 4, a graph showing the pull weight required to release the sear for different holding weights H is illustrated generally by numeral 400. The pull weight is shown for both a standard trigger device and the elastic trigger device 100 as described above. For each measurement, three samples were taken. All three samples may not be distinctly identifiable due to overlap in the results. As shown, the pull weight for a standard trigger increases linearly as the holding weight H increases. For example, for the standard trigger with a holding weight H of 100 lbf, the pull weight to release the sear was approximately 24 to 26 oz. For the standard trigger with a holding weight H of 400 lbf, the pull weight to release the sear was approximately 44 to 46 OZ.

In contrast, for the elastic trigger device 100 with a holding weight H of 100 lbf, the pull weight to release the sear was approximately 20 to 22 oz. For the elastic trigger device 100 with a holding weight H of 400 lbf, the pull weight to release the sear was approximately 24 to 28 oz. In contrast to the standard trigger, the pull weight for the elastic trigger device 100 peaked for a holding weight H of 250 lbf at approximately 31 to 35 oz. Thus, it will be appreciated that the pull weight for the elastic trigger at higher holding weights H is significantly less than the pull weight for the standard trigger.

Accordingly, it will be appreciated that the trigger device described above provides a latch with a flexure design. The flexure design of the latch is configured to change the angle at which the latch engages the sear under an increasing holding weight. Changing the angle of engagement reduces the moment arm of latch force L in relation to the sear pivot pin. The reduction in the moment arm reduces the pull weight required to release the sear to, at least partially, compensate for the pull weight added due to the increased holding weight.

Although the trigger device has been described above with reference to specific embodiments, variations will become apparent to a person skilled in the art. For example, although the latch 104 is described as being rotatably coupled to the string hook 102, in an embodiment, the latch 104 may be fixedly attached to the string hook 102. In another embodiment, the latch 104 and the string hook 102 may comprise a unitary construction. In an embodiment, the latch 104 may engage the sear 108 directly, without the use of the main roller 106.

Further, the terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top", "bottom," and the like, may be used herein for ease of description to describe one element's or feature's relationship to another element(s) or feature(s) as illustrated in the figures. For convenience, the relative terms used in the application relate to a user holding a crossbow facing forward as a reference frame. However, spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

This written description uses examples to disclose the embodiments, including the best mode, and also to enable those of ordinary skill in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

Also, the use of "a" or "an" is employed to describe elements and components described herein. This is done merely for convenience and to give a general sense of the scope of the invention. This description should be read to include one or at least one and the singular also includes the plural unless it states otherwise.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, sacrosanct or an essential feature of any or all the claims.

After reading the specification, skilled artisans will appreciate that certain features which are, for clarity, described herein in the context of separate embodiments, can also be provided in combination in a single embodiment. Conversely, various features that are, for brevity, described in the context of a single embodiment, can also be provided separately or in any sub-combination. Further, references to values stated in ranges include each and every value within that range.

What is claimed is:

1. A trigger device comprising:

a string hook configured to retain a bowstring;

a trigger;

a sear coupled to the trigger, the sear configured to release the string hook in response to actuation of the trigger; and a flexible latch coupled between the string hook and the sear, the flexible latch having a flexure design configured to flex in response to a holding weight applied by the bowstring, wherein flexure of the flexible latch reduces a pull weight of the trigger.

2. The trigger device of claim 1, wherein the flexure of the flexible latch reduces a pull weight of the trigger by changing an angle of engagement at which the flexible latch engages the sear as the holding weight increases.

3. The trigger device of claim 2, wherein changing the angle of engagement reduces a moment arm of a latch force L in relation to a pivot pin of the sear, the reduction in the moment arm thereby reducing the pull weight required to release the sear.

4. The trigger device of claim 1, wherein the flexure design comprises a flexible leg formed in a bottom portion of the flexible latch, the flexible leg comprising a forward facing sear engagement surface.

5. The trigger device of claim 1, further comprising a main roller coupled between the sear and the flexible latch, the main roller configured to rotate about its axis and translate within predefined slots in the trigger device.

6. The trigger device of claim 4, where the flexible leg is formed by creating a channel in the latch.

7. The trigger device of claim 6, wherein the channel is shaped to mirror a contour of the flexible leg.

8. The trigger device of claim 6, wherein the width of the channel is sized to provide a maximum flex of the flexible leg.

9. The trigger device of claim 8, wherein at least one stopper pin is positioned within the channel, thereby tuning the maximum flex of the flexible leg.

10. The trigger device of claim 1, wherein the flexible latch is rotatably coupled to the string hook.

11. The trigger device of claim 1, wherein the flexible latch is fixedly attached to the string hook.

12. The trigger device of claim 1, wherein the flexible latch and the string hook comprise a unitary construction.

13. The trigger device of claim 1, wherein the sear is coupled to the trigger via a secondary roller configured to translate under pressure from the trigger.

* * * * *